US006863471B2

(12) United States Patent
Medendorp

(10) Patent No.: US 6,863,471 B2
(45) Date of Patent: Mar. 8, 2005

(54) KIT AND CASE FOR STORING AND TRANSPORTING A CONCRETE FINISHING TOOL

(75) Inventor: David J. Medendorp, Racine, WI (US)

(73) Assignee: The Fall River Group, Inc., Milwaukee, WI (US)

( * ) Notice: Subject to any disclaimer, the term of this patent is extended or adjusted under 35 U.S.C. 154(b) by 0 days.

(21) Appl. No.: 10/803,305

(22) Filed: Mar. 18, 2004

(65) Prior Publication Data

US 2004/0223809 A1 Nov. 11, 2004

Related U.S. Application Data

(62) Division of application No. 10/447,388, filed on May 29, 2003, now Pat. No. 6,709,196.

(60) Provisional application No. 60/468,776, filed on May 8, 2003.

(51) Int. Cl.[7] ..... A45C 11/26

(52) U.S. Cl. ..... 404/118; 206/349

(58) Field of Search ..... 206/140, 315.11, 206/349, 375, 373, 443, 446; 404/118

(56) References Cited

U.S. PATENT DOCUMENTS 2,639,454 A * 5/1953 Dory ..... 15/245
2,800,221 A * 7/1957 Butler et al. ..... 206/375
3,744,663 A * 7/1973 Moren ..... 220/4.27
5,520,400 A * 5/1996 Hung ..... 280/47.26
6,230,949 B1 * 5/2001 O'Connell et al. ..... 224/557
6,626,286 B2 * 9/2003 Boutet et al. ..... 206/3
6,634,503 B2 * 10/2003 Welsh, Jr. ..... 206/553

* cited by examiner

*Primary Examiner*—Gary S. Hartmann
(74) *Attorney, Agent, or Firm*—Andrus, Sceales, Starke & Sawall, LLP

(57) ABSTRACT

A concrete finishing tool storage case is used to retain and transport a partially disassembled concrete finishing tool having a variously sized concrete float. A case includes a cover moveable into engagement with a base to define a closed position, and moveable away from the base to define an open position. The cover has a lower surface provided with a series of spaced apart, parallel downwardly facing grooves adapted to receive a concrete float connected to a concrete float adjusting device. An upper surface of the cover is formed with a cut-out adapted to receive the concrete float adjusting device connected to the concrete float. The base has a number of spaced apart barriers, adjacent pairs of barriers defining a set of channels adapted to frictionally receive a plurality of handle extensions collectively attached to the float adjusting device. Certain of the barriers are formed with pockets adapted to receive and support the concrete float connected to the concrete float adjusting device. The storage case, the concrete float, the concrete float adjusting device and the handle extensions are collectively included together in a kit which is useful at a concrete finishing work site.

5 Claims, 3 Drawing Sheets

KIT AND CASE FOR STORING AND TRANSPORTING A CONCRETE FINISHING TOOL

This application is a divisional application of application Ser. No. 10/447,388 filed on May 29, 2003, now U.S. Pat. No. 6,709,196, which issued on Mar. 23, 2004 which claims the benefit of Provisional application Ser. No. 60/468,776, filed May 8, 2003.

FIELD OF THE INVENTION

The present invention relates broadly to a structure for managing the disassembled components of a concrete finishing tool. More particularly, the present invention pertains to a kit and carrying case for retaining and transporting together a concrete finishing float, a float adjusting device, and a plurality of handle extensions in an organized manner which will improve efficiency at a concrete finishing site.

BACKGROUND OF THE INVENTION

It is common practice to use a concrete finishing tool having a finishing float for the purpose of providing a smooth finish to large slabs of freshly poured concrete. A typical large-sized float employed in concrete finishing may be 48 inches long by 8 inches wide by ¾ inches high. During use, it is desirable that such tools are provided with a device coupled to the float for adjustably tilting a work face of the float from a remote end of a handle connected to the float adjusting device. Such an adjustment facilitates forward pushing and backward pulling of the float as it moves over the wet soft concrete surface. Long reach floats are often provided with sectionalized handles made up of several extension pieces which are removably interconnected to each other and to the float adjusting device. These long reach handles are necessary as it is undesirable to walk over an unset concrete surface since to do so would disturb the natural setting and separation processes associated with concrete curing. A concrete finishing tool may be provided with several such handle sections, each of which may typically measure 4 feet in length and 1¾ inches in outer diameter.

After a concrete finishing operation, each of the handle sections is disassembled from the float tilting device coupled to the float. This collection of variously sized components is then typically carried by more than one laborer and stored piecemeal such as in the back of a truck or trailer. Unfortunately, it is possible that this type of storage can lead to loss or damage of individual finishing tool components which may come into contact with each other or different equipment while stored and transported. When it is desired to again use the concrete finishing tool, personnel must retrieve and carry the loosely distributed components to the work site. As a result, breakdown and reassembly of the concrete finishing tool components can be retarded or impaired, and thereby negatively affect the overall efficiency at the concrete finishing site.

SUMMARY OF THE INVENTION

It is one object of the present invention to provide a system for managing and establishing an orderly disposition of the disassembled components of a concrete finishing tool.

It is also an object of the present invention to provide an arrangement for reducing the time and effort required in the handling of concrete finishing equipment.

It is another object of the present invention to provide a specially designed container for holding a concrete finishing float, a float adjusting device and a plurality of handle extensions in a secure, organized manner.

It is a further object of the present invention to provide a particularly constructed and arranged storage receptacle which enables a single laborer to easily transport concrete finishing tool elements to and from a concrete finishing work site.

It is an additional object of the present invention to provide a rugged, durable and lightweight affordable case that maintains components of a concrete finishing tool in a stacked and spaced apart arrangement.

It is still another object of the present invention to provide a storage case which will accommodate different sizes of concrete floats.

Yet another object of the present invention is to provide a kit for more conveniently storing and retrieving a long handled, adjustable concrete float.

In one aspect of the invention, a concrete finishing tool kit includes an elongated concrete float adapted to engage and smooth a wet concrete surface. A concrete float adjusting device is adapted to be connected to the concrete float for selectively tilting the concrete float. An elongated handle structure is adapted to be removably attached to the concrete float adjusting device for pushing and pulling the concrete float and causing tilting of the concrete float. A storage case contains the concrete float adjusting device connected to the float, and the handle structure in a spaced apart, stacked arrangement. The case has a cover selectively engaged with and disengaged from a base. The cover has a first retention structure for receiving the float adjusting device and the float connected thereto, and at least preventing movement of the float adjusting device and the float in a direction parallel to a longitudinal axis of the float. The base has second retention structure for receiving and retaining the handle structure and preventing movement of the handle structure in a direction parallel to and transverse to a longitudinal axis of the handle structure. Either the cover or the base has third retention structure for receiving the float connected to the float adjusting device and preventing movement of the float and the float adjusting device in a direction transverse to the longitudinal axis of the float.

The cover has a lower surface provided with a downwardly facing groove arrangement for receiving upper portions of the float. An upper surface of the cover is formed with a cut-out for receiving lower portions of the float adjusting device such that upper portions of the float adjusting device are exposed above the upper surface of the cover. The base has an upwardly facing channel arrangement for frictionally receiving the handle structure beneath the float and a pocket arrangement for receiving front and rear portions of the float. The groove arrangement extends completely across the lower surface of the cover except for an area interrupted by the cut-out for enabling end portions of the float to extend beyond the storage case. The channel arrangement and the pocket arrangement extend completely across the base for enabling end portions of the handle structure frictionally received therein and the float to extend beyond the storage case. The channel arrangement is formed by a series of spaced apart, upstanding barriers which provide support surfaces for the float. Each adjacent pair of barriers is connected by wall structure defining a U-shaped channel therebetween. Each wall structure includes a resilient, deflectable tab arrangement engageable with the handle structure for frictionally retaining the handle structure in the U-shaped channel. Certain of the barriers are formed with adjoining necks and shoulders engageable with the float. A rear portion of the cover is hingedly mounted to a rear portion of the base. The cover and the base are removably connected together at respective front portions thereof. The front portions of the cover and the base include respective cooperable storage case handles. The groove arrangement preferably includes four grooves extending parallel to each other. The channel arrangement preferably includes four channels extending parallel to each other. The pocket arrangement preferably includes a pair of oppositely facing pockets formed in certain of the barriers. The handle structure includes a series of handle extensions collectively attached to each other and to the float adjusting device.

The invention also contemplates a method for retaining and storing a disassembled concrete finishing tool having a concrete float with front and rear upstanding ribs and a pair of intermediate upstanding ribs attached to a concrete float adjusting device, and a series of handle extensions adapted to be connected together and to the concrete float adjusting device. The method includes the steps of providing a storage case having a cover movably connected to a base between an open position and a closed, locked position, the cover having a lower surface provided with spaced apart, parallel, downwardly facing front, rear and a pair of intermediate grooves for receiving the ribs of the float, and an upper surface having internal walls forming a cut-out for receiving the float adjusting device connected to the float, the walls forming the cut-out being engageable with peripheral walls of the float adjusting device, the base being provided with a plurality of barriers, adjacent pairs of barriers being connected by wall structure, each having a resilient deflectable, retaining tab arrangement extending therefrom, and the barriers forming a number of spaced apart, parallel, upwardly facing channels for receiving the handle extensions, two of the barriers being formed with pockets therein; with the cover in the open position, inserting each of the handle extensions into one of the channels such that the handle extension frictionally engages the respective tab structure, and is centrally positioned along a length of the handle extension relative to the base; placing the float upon at least two of the barriers and between the pockets such that the float is centrally positioned along a length thereof relative to the base; and moving the cover to the closed, locked position upon the base such that a portion of the concrete float adjusting device passes through the cut-out formed in the cover, and certain of the ribs are received in the grooves or the pockets.

In another aspect of the invention, a concrete finishing tool storage case is adapted to retain and transport a partially disassembled concrete finishing tool. The case includes a cover moveable into engagement with a base to define a closed position, and moveable away from the base to define an open position. The cover has a lower surface provided with a series of spaced apart, downwardly facing grooves extending parallel to each other and adapted to receive a concrete float connected to a concrete float adjusting device. An upper surface of a cover is formed with a cut-out extending inwardly from a front edge of the cover and adapted to receive the concrete float adjusting device connected to the concrete float. The base has a number of spaced apart barriers, adjacent pairs of barriers defining a set of channels extending parallel to each other and adapted to frictionally receive a plurality of handle extensions collectively attached to each other and the float adjusting device. Certain of the barriers are formed with pockets adapted to receive and support the concrete float connected to the concrete float adjusting device. The grooves extend completely across the lower surface of the cover except for an area interrupted by the cut-out, and are adapted to receive the float having end portions projecting beyond side portions of the storage case. The channels and the pockets extend completely across the base. The channels are adapted to receive the handle extensions having end portions projecting beyond the side portions of the storage case. The pockets are adapted to receive the float having end portions projecting beyond the side portions of the storage case. Each of the barriers are provided with at least one resilient, deflectable tab adapted to be engaged by one of the handle extensions. The grooves and the pockets permit the storage of differently sized floats.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
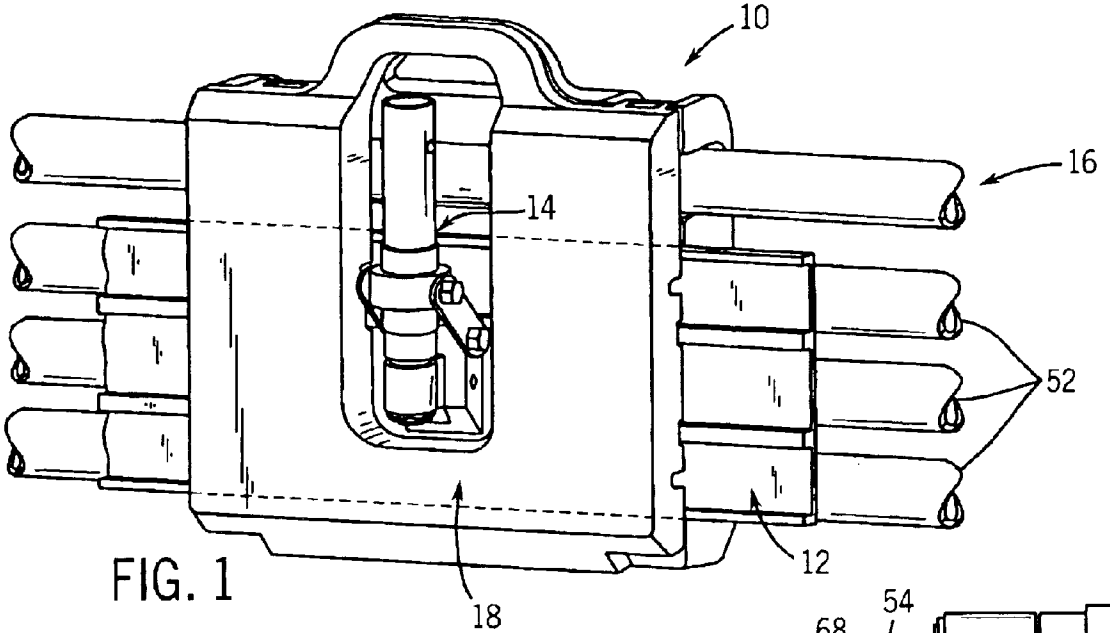
FIG. 1 is a perspective view of a kit or a concrete finishing tool according to the present invention.
Figure 2:
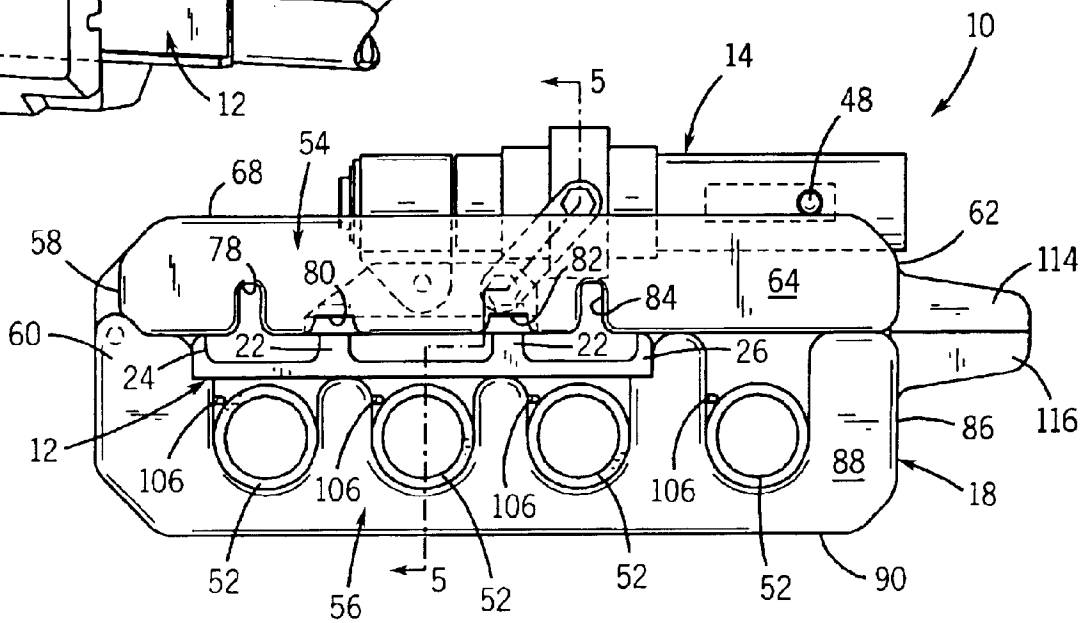
FIG. 2 is an end view taken from the right side of FIG. 1 showing one size of float included therein.
Figure 3A:
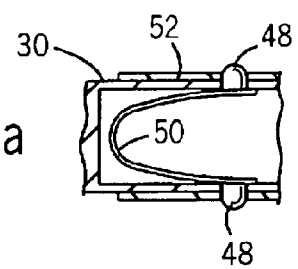
FIG. 3*a* is an enlarged sectional view taken on line 3*a*—3*a* of FIG. 3.
Figure 3:
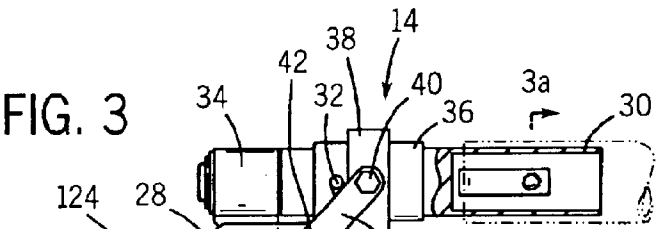
FIG. 3 is an exploded view of the components of FIG. 3.

Referring now to the drawings, FIGS. 1–3 illustrate a concrete finishing tool kit 10 for storing and transporting a disassembled concrete finishing tool in an organized manner. The kit 10 is comprised of an elongated concrete float 12, a concrete float adjusting device 14, an elongated handle structure 16 and a storage case 18.

The float 12 includes a surfacing face 20, a pair of intermediate longitudinal ribs 22, a front longitudinal rib 24 and a rear longitudinal rib 26. In use, the surfacing face 20 engages a wet concrete surface to create a desired surface texture or gradient as is well known. The ribs 22, 24, 26 are provided to improve the structural strength of the float 12 and provide an attachment surface for the concrete float adjusting device 14. In the preferred embodiment of FIGS. 1–5, the float 12 has an elongated shape which typically measures 48 inches in length, 8 inches in width and ¾ inches in height, but which, of course, can vary in size according to requirements of the concrete finishing operation. For example, another well known sized float 12' shown in FIG. 6 has a variable length with a width of 6 inches and a height of 1½ inches. As will be appreciated later, the storage case 18 conveniently accommodates either float 12 or 12'.

The float adjusting device 14 is adapted to be connected to the float 12 for selectively tilting the float 12 as the latter is being pulled or pushed over the freshly poured concrete surface so as to prevent gouging of the unset surface thereof. As best seen in FIG. 3, the float adjusting device 14 generally includes a foot 28, an elongate shaft 30 provided with a spiral slot formation 32, a pivot bearing 34, a protective sleeve 36, a follower sleeve 38, upper pivot shaft structure 40, lower pivot shaft structure 42 and a link arm arrangement 44. The foot 28 is coupled to the intermediate ribs 22 of the float 12 by a set of bolts 46. A rear portion of the shaft 30 includes a detent system having a pair of oppositely disposed detents 48 biased outwardly through the shaft 30 by a U-shaped spring 50 (FIG. 3*a*) to enable a quick coupling of the handle structure 16. Rotation of the rear portion of the shaft 30 and the spiral slot formation 32 included therein via the handle structure 16 causes the follower sleeve 38 and the protective sleeve 36 to slide linearly along a middle portion of the shaft 30 as the upper pivot shaft structure 40 connecting the follow sleeve 38 and protective sleeve 36 follow the path of the spiral slot formation 32. This linear motion results in transmitting movement to the foot 28 through shifting movement of the link arm arrangement 44 so as to tilt the float 12 relative to the shaft 30. Further details of such a float adjusting device 14 are disclosed in provisional U.S. patent application Ser. No. 60/468,776 filed May 9, 2003, which is herein incorporated by reference.

The handle structure 16 is adapted to be removably attached to the float adjusting device 14 for pushing and pulling and causing tilting of the float 12. The handle structure 16 includes a series of elongated handle extensions 52 which are easily connected together by well known cooperating detent structure (not shown) on the ends of adjacently disposed handle extensions 52. Such detent structure is similar to the detents 48 described above which connect handle structure 16 to the rear portion of the shaft 30. Each of the handle extensions 52 typically is formed with a length of 6 feet and an outer diameter of 1¾ inches. When these handle extensions 52 are coupled together, a long reach handle of about 24 feet is made available. In the preferred embodiment, four such handle extensions 52 are shown in disassembled form, but it can be appreciated that the number and length of these handle extensions 52 can vary.

The storage case 18 contains the float adjusting device 14 connected to the float 12, and the handle structure 16 in a spaced apart, stacked arrangement. With reference to FIGS. 1, 2, 3 and 4, the storage case 18 includes a cover 54 which is selectively engaged with and disengaged from a base 56. More particularly, a rear portion 58 of the cover 54 is hingedly connected to a rear portion 60 of the base 56 between an open position (FIGS. 3 and 4) and a closed, locked position (FIGS. 1 and 2). Besides rear portion 58, the cover 54 includes a front portion 62, opposed side portions 64, a lower surface 66 and an upper surface 68. The lower surface 66 is provided with a downwardly facing groove arrangement for receiving the ribs 22, 24, 26 or upper portions of the float 12. The upper surface 68 is formed with walls 70, 72, 74 (FIG. 5) forming a cut-out 76 extending inwardly from the front portion 62 of cover 54 for receiving the foot 28, the bottom of the pivot bearing 34, the lower pivot shaft structure 40, the bottom of the link arm arrangement 44, and bottoms of the shaft 30, protective sleeve 36 and follower sleeve 38 or lower portions of the float adjusting device 14. The groove arrangement preferably includes four grooves 78, 80, 82, 84 which extend parallel to each other and extend substantially completely across the lower surface 66 of the cover 54 except for an area interrupted by the cut-out 76 for enabling end portions of the float 12 to extend beyond the side portions of the case 18.

In addition to rear portion 60, the base 56 includes a front portion 86, opposed side portions 88, a lower surface 90 and an upper surface 92. The upper surface 92 is provided with an upwardly facing channel arrangement for frictionally receiving the handle extensions 52 beneath the float 12, and a pocket arrangement for receiving the front and rear portions of the float 12. The channel arrangement and the pocket arrangement extend completely across the upper surface 92 of the base 56 for respectively enabling end portions of the handle extensions 52 received therein, and end portions of the float 12 to extend beyond the side portions of the case 18.

Figure 4:
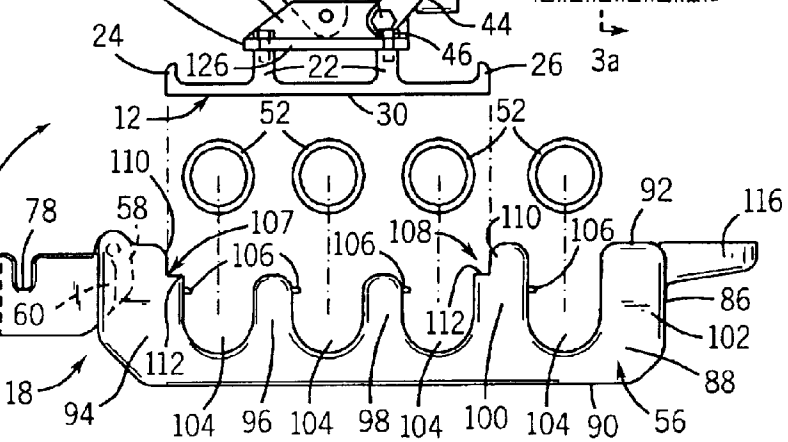
FIG. 4 is a perspective view of the storage case used in the kit of FIG. 1.
Figure 4:
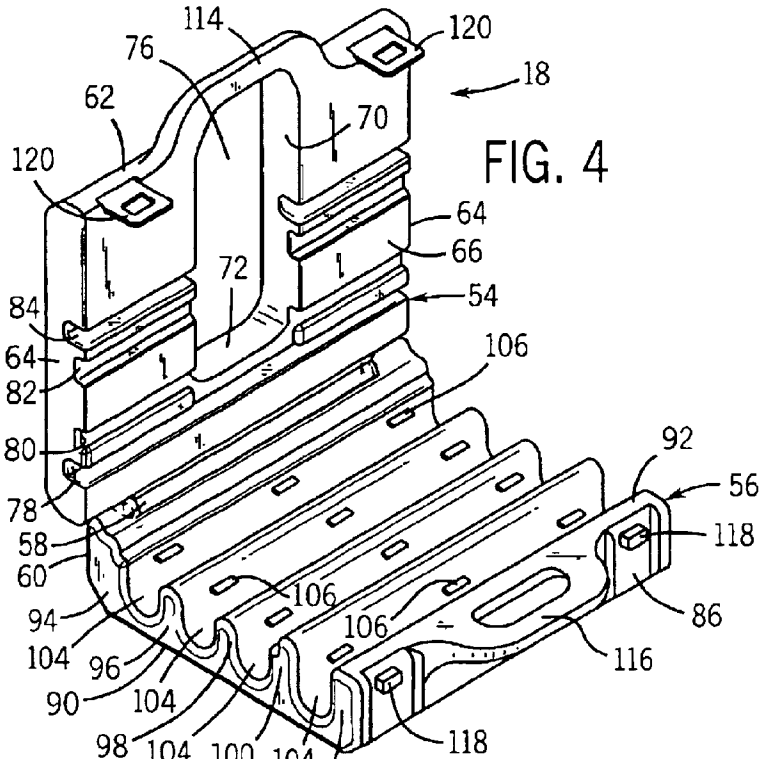
Figure 5:
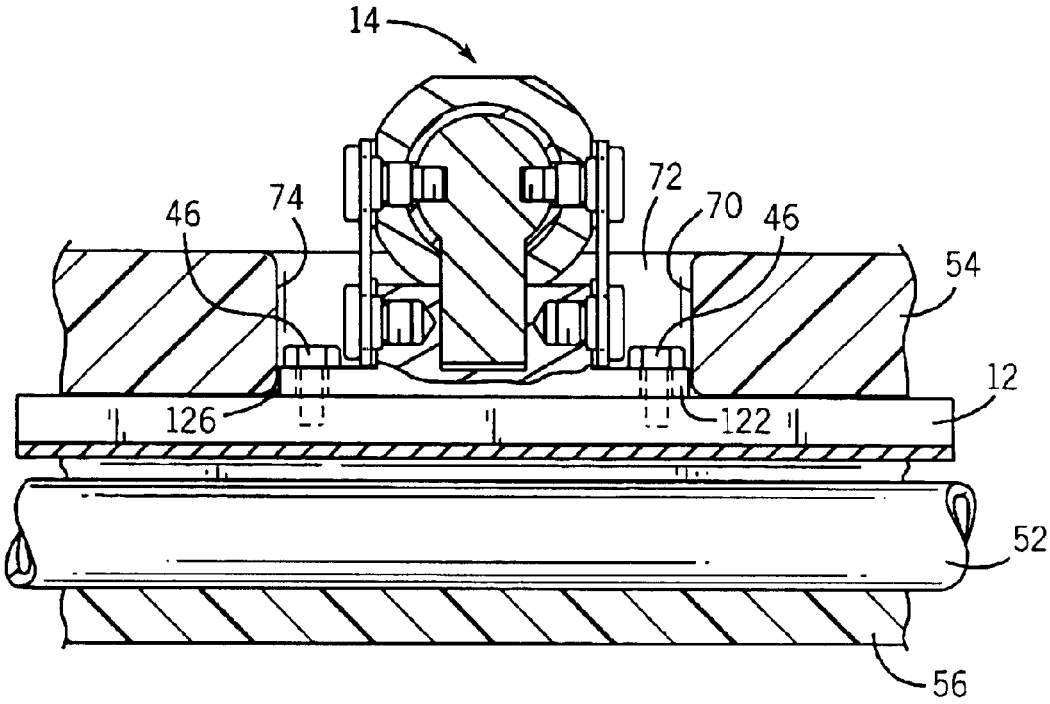
FIG. 5 is a sectional view taken on line 5—5 of the FIG. 2.

The channel arrangement is formed by a series of spaced apart, upstanding, float supporting barriers 94, 96, 98, 100, 102. Each adjacent pair of barriers 94–102 is connected by wall structure defining a U-shaped channel therebetween. The preferred embodiment shows four identical channels 104 which extend parallel to each other. Each channel wall structure includes a resilient, deflectable tab arrangement engaged with the handle extensions 52 for facilitating frictional retention of the handle extensions 52 within each channel 104. Preferably, each tab arrangement has three longitudinally spaced apart tabs 106 as best seen in FIG. 4. Each tab 106 is designed to be located on the barrier wall structure such that the tab 106 will initially deflect downwardly when one of the handle extensions 52 is pushed into one of the channels 104, and then will snap back to a generally horizontal position (FIGS. 2 and 6) to frictionally restrain the handle extensions 52 from moving longitudinally and vertically in the channel 104.

The pocket arrangement is preferably defined by a pair of oppositely facing pockets 107, 108. Each pocket 107, 108 is provided by an adjoining neck 110 and shoulder 112 formed on the barriers 94 and 100 as best seen in FIG. 3. Each neck 110 and shoulder 112 is supportively engaged by the front and rear ribs 24, 26, respectively, of the float 12 illustrated in FIG. 2. Also, it should be understood that top surfaces of barriers 96, 98 commonly provide support for either of the floats 12 or 12'.

Figure 6:
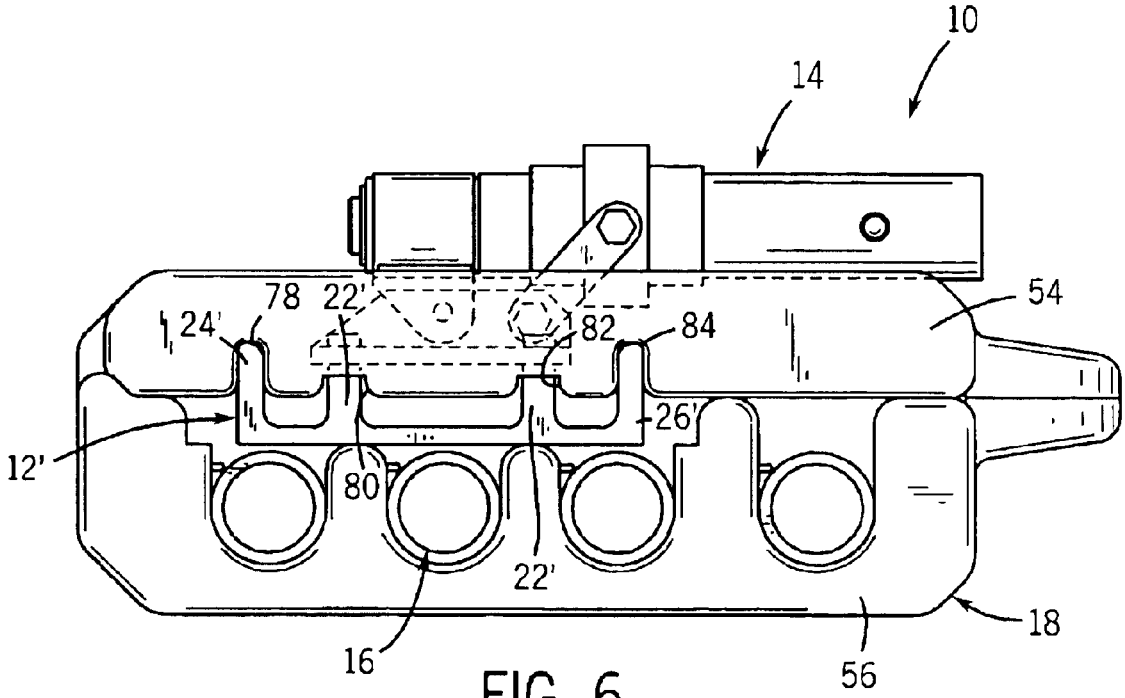
FIG. 6 is a view like FIG. 2 showing a differently sized float accommodated in the kit.

The respective front portions 62, 86 of the cover 54 and the base 56 are integrally formed with respective cooperating carrying handles 114, 116 which lie one on top of the other when the case 18 is closed (FIGS. 2 and 6). In addition, the front portion 86 of the base 56 is formed with a pair of spaced apart, forwardly protruding catches 118 on opposite sides of the handle 116. The front portion 62 of the cover 54 is provided with a pair of depending flexible latches 120 on opposite sides of the handle 114. The latches 120 are aligned with the catches 118 such that when the cover 54 is pivoted from the open position of FIG. 4 to the closed position of FIGS. 2 and 6, the latches 120 frictionally receive the catches 118 and provide a simple effective locking relationship between the cover 54 and the base 56.

Referring to FIG. 3, at the termination of a concrete finishing operation, each of the handle extensions 52 is disconnected from each other and from the rear portion of the float adjusting device 14 so that there are four loose handle extensions 52 and the float 12 coupled to the float adjusting device 14. With the cover 54 in the open position, each of the handle extensions 52 is inserted into one of the channels 104 such that each handle extension 52 frictionally engages the tabs 106. Each handle extension 52 is centrally positioned relative to the base 56 of the case 18 along a length of the handle extension 52. The handle extensions 52 when inserted into channels 104 are prevented from forward and rearward movement due to the barriers 94–102. Next, the surfacing face 20 of the float 12 connected to the float adjusting device 14 is placed upon the two barriers 96, 98 and between the two pockets 107, 108 such that the float 12 is centrally positioned along a length thereof relative to the base 56 of the case 18. With the float 12 of FIG. 2, the front and rear ribs 24, 26, respectively, of the float 12 are engaged against the shoulders 112 and necks 110 forming each pocket 107, 108 so that the float 12 is prevented from moving backwards and forwards relative to the base 56. Finally, the cover 54 is pivoted closed such that a portion of the float adjusting device 14 passes through the cut-out 76 in the cover 54. During the closing movement, the walls 70, 72, 74 forming the cut-out 76 progressively engage the peripheral walls 122, 124, 126 (FIGS. 3 and 5) of the float adjusting device foot 28 to prevent side to side movement of the float 12 and its connected float adjusting device 14 as understood from FIG. 5. When the cover 54 is fully closed upon the base 56, the bottom plane of the foot 28 is substantially coplanar with the lower surface 66 of the cover 54. As seen in FIG. 2, this means that lower portions of the float adjusting device 14 are received within the cut-out 76, and upper portions of the float adjusting device 14 are exposed above the upper surface 68 of the cover 54. It can also be appreciated that the float 12 and its connected float adjusting device 14 are prevented from vertical movement due to the engagement of the respective front and rear ribs 24, 26 of the float 12 between the lower surface 66 of the cover 54 and the shoulders 112 on the base 56. Once the cover 54 is closed, the latches 120 and catches 118 are cooperatively engaged so as to lock the storage case 18. The handles 114, 116 can then be grasped to conveniently carry the float 12, float adjusting device 14 and handle extensions 52 in a secure, organized system. When it is desired to reassemble the concrete finishing tool, the cover 54 is unlocked and opened to enable the handle extensions 52 to be quickly removed and reattached to each other and to the easily removed float adjusting device 14 which remains coupled to the float 12.

As mentioned previously, the storage case 18 is advantageously designed to retain and store the differently sized float 12' which in FIG. 6 has a width which is less than the width of the float 12 and a height which is greater than the height of the float 12. Storage of the finishing tool components is similar to that described above except that as the cover 54 is closed, the progressive engagement of the peripheral walls 122, 124, 126 of the float adjusting device 14 with the walls 70, 72, 74 forming the cut-out 76 will self-orient the float 12'. That is, the front and rear ribs 24', 26', respectively, of float 12' will be received in respective front and rear grooves 78, 84, and the intermediate ribs 22' will be received in intermediate grooves 80, 82 so as to again prevent vertical movement of the float 12' and the connected float adjusting device 14. In this version, the float adjusting device 14 sits slightly higher relative to the cover 54.

The cover 54 thus defines first retention structure (cut-out 76) for receiving the float adjusting device 14 with the float 12 or 12' connected thereto, and at least preventing movement of the float adjusting device 14 and the float 12 or 12' in a direction parallel to a longitudinal axis of the float 12 or 12'. The base 56 has second retention structure (barriers 94–102, channels 104 and tabs 106) for receiving and retaining the handle structure 16 and preventing movement of the handle structure in a direction parallel and transverse to a longitudinal axis of the handle structure 16. Either the cover 54 or the base 56 has third retention structure (grooves 78–82 or pockets 107, 108) for receiving the float 12 or 12' connected to the float adjusting device 14 and preventing movement of the float 12 or 12' and the float adjusting device 14 in a direction transverse to the longitudinal axis of the float 12 or 12'.

It should now be appreciated that the present invention provides a unique system for managing disassembled components of a concrete finishing tool in a spaced apart, stacked arrangement. The present invention also provides a specially constructed and arranged, affordable storage case 18 which accommodates different sizes of concrete floats. The kit 10 is provided which reduces the time and effort previously required in the handling of concrete finishing equipment, and enables a single laborer to easily transport concrete finishing tool components to and from a concrete finishing work site. This kit 10 overcomes the previous problems of loss and/or damage to finishing tool components which occurred in prior breakdown and reassembly before and after a concrete finishing operation.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A concrete finishing tool storage case adapted to retain and transport a partially disassembled concrete finishing tool, the case comprising:

a cover moveable into engagement with a base to define a closed position, and moveable away from the base to define an open position, the cover having a lower surface provided with a series of spaced apart, downwardly facing grooves extending parallel to each other and adapted to receive a concrete float connected to a concrete float adjusting device, and an upper surface formed with a cut-out extending inwardly from a front portion of the cover and adapted to receive the concrete float adjusting device connected to the concrete float, the base having a number of spaced apart barriers, adjacent pairs of barriers defining a set of upwardly facing channels extending parallel to each other and adapted to frictionally receive a plurality of handle extensions collectively attached to the float adjusting device, certain of the barriers being formed with pockets adapted to receive and support the concrete float.

2. The storage case of claim 1, wherein the grooves extend completely across the lower surface of the cover except for an area interrupted by the cut-out, the grooves being adapted to receive the float having end portions projecting beyond side portions of the case.

3. The storage case of claim 1, wherein the channels and the pockets extend completely across the base, the channels being adapted to receive the handle extensions having end portions projecting beyond the side portions of the case, and the pockets being adapted to receive the float having end portions projecting beyond the side portions of the case.

4. The storage case of claim 1, wherein each of the barriers are provided with at least one resilient, deflectable tab adapted to be engaged by one of the handle extensions.

5. The storage case of claim 1, wherein the grooves and the pockets permit the storage of differently sized floats.

* * * * *